US008197236B2

(12) United States Patent
McIntosh

(10) Patent No.: US 8,197,236 B2
(45) Date of Patent: Jun. 12, 2012

(54) ADJUSTABLE ROLLER PUMP ROTOR

(75) Inventor: Kevin D. McIntosh, Brooklyn Park, MN (US)

(73) Assignee: Medtronic, Inc., Minneapolis, MN (US)

( * ) Notice: Subject to any disclaimer, the term of this patent is extended or adjusted under 35 U.S.C. 154(b) by 679 days.

(21) Appl. No.: 12/315,842

(22) Filed: Dec. 5, 2008

(65) Prior Publication Data

US 2009/0269228 A1 Oct. 29, 2009

Related U.S. Application Data

(60) Provisional application No. 61/125,523, filed on Apr. 25, 2008.

(51) Int. Cl.
*F04B 43/08* (2006.01)
*F04B 43/12* (2006.01)
*F04B 45/06* (2006.01)

(52) U.S. Cl. ..... 417/477.7; 417/477.8; 604/153

(58) Field of Classification Search .... 417/477.6–477.8; 604/151, 153

See application file for complete search history.

(56) References Cited

U.S. PATENT DOCUMENTS

| | | | | | |
|---|---|---|---|---|---|
| 487,136 | A * | 11/1892 | Truax | 417/477.8 |
| 3,192,863 | A * | 7/1965 | Vadot | 417/477.7 |
| 3,848,592 | A * | 11/1974 | Willock | 604/6.05 |
| 4,363,609 | A * | 12/1982 | Cosentino et al. | 417/477.5 |
| 4,573,884 | A * | 3/1986 | Troutner | 417/374 |
| 5,096,393 | A * | 3/1992 | Van Steenderen et al. | 417/475 |
| 5,263,831 | A * | 11/1993 | Kappus | 417/477.7 |
| 5,657,000 | A * | 8/1997 | Ellingboe | 340/608 |
| 5,759,017 | A * | 6/1998 | Patton et al. | 417/477.9 |
| 6,019,582 | A * | 2/2000 | Green | 417/477.8 |
| 6,736,617 | B2 * | 5/2004 | Domroese | 417/477.7 |
| 7,037,092 | B2 * | 5/2006 | Kagawa et al. | 417/476 |
| 2007/0073097 | A1 * | 3/2007 | Borra et al. | 600/16 |

FOREIGN PATENT DOCUMENTS

| | | |
|---|---|---|
| IT | MO2005/000243 | 9/2005 |
| IT | MO2005/000244 | 9/2005 |

* cited by examiner

*Primary Examiner* — Devon C Kramer
*Assistant Examiner* — Joseph Herrmann

(57) ABSTRACT

A pump rotor for a roller pump, is disclosed. The rotor comprises: a first roller support comprising a first roller; a second roller support comprising a second roller; an element in the center connected to the first and second roller supports, wherein the first and second roller supports may move angularly with respect to the center element causing distance between the first and second rollers to be varied; first and second positioning elements that connect the first and second roller supports, respectively, to the center element; and first and second spring biased components surrounding first and second positioning elements, respectively, to allow the first and second roller supports to move to allow for automatic adjustment of the rotor.

12 Claims, 6 Drawing Sheets

ADJUSTABLE ROLLER PUMP ROTOR

PRIORITY

The present non-provisional patent application claims benefit from U.S. Provisional Patent Application having Ser. No. 61/125,523, filed on Apr. 25, 2008, by McIntosh, and titled ADJUSTABLE ROLLER PUMP ROTOR, wherein the entirety of said provisional patent application is incorporated herein by reference.

FIELD OF THE INVENTION

The present invention relates to roller pumps used in medical devices or systems (e.g., heart-lung bypass machines). More particularly, the present invention relates to a roller pump rotor that is both manually adjustable in the surgical field to vary the distance between rollers on the rotor causing a change in the amount of occlusion of tubing in the roller pump, and automatically adjustable during operation using spring biasing components or other adjustment means that allow the distance between rollers to be reduced for slight variations in tubing diameters or wall thickness.

BACKGROUND OF THE INVENTION

Roller (or peristaltic) pumps have many uses in the medical field. For example, roller pumps are used during cardiovascular surgery to facilitate circulation of blood between a patient and a heart-lung machine. Other common medical uses are the transfer of blood between a patient and a kidney dialyzer, and intravenous (IV) feeding of IV solutions. Generally, roller pumps are simply structured, generate a constant flow, and use disposable tubing through which a fluid medium is transferred.

Roller pumps generally comprise a pump drive and a pump head. The pump drive is a unit that drives or causes rotation in the pump head in order for the roller pump to pump a fluid medium. The pump head comprises a pump stator and a pump rotor. The pump stator is essentially a chamber or housing having an inner circumferential surface against which one or more tubes are compressed by the pump rotor. The pump rotor, which is rotatable, is arranged in the pump stator in such a manner that the pump rotor engages tubing positioned in the pump stator with one or more rollers. Upon rotation of the pump rotor by a rotating shaft that is part of the pump drive, the rollers compress the tubing against the inner circumferential surface of the pump stator as they are rolled along the tubing. The fluid medium contained in the tubing is then transported in a direction of the pump rotor rotation.

It is important that roller pumps be adjustable. One way that roller pumps are generally adjustable is with regard to the rate of rotation of the rotor, including the rollers. The rate of rotation affects the amount of fluid medium that may be transferred by the pump. The rate of rotation of the rollers is generally adjusted using controls on the pump or the system in which the pump is integrated.

Another way that roller pumps are generally adjustable is with regard to the distance between the rollers. There are a couple of reasons that the distance between the rollers may be varied. First, the distance between the rollers may be varied to change the amount that the rollers occlude or compress the diameter of the tubing in the pump as they move, which affects the pumping rate. The amount of occlusion of the tubing also affects the amount of suction on the fluid medium by the roller pump. If the roller pump is used in certain portions of the anatomy, there may be limits on the amount of suction that may be applied safely to withdraw a fluid medium. An example of such a use for a roller pump is connected to a heart vent line, where too much suction could result in tissue damage.

Second, the distance between the rollers may be adjusted to allow for tubing having different sizes or qualities to be used in a roller pump. Tubing that is commonly used in roller pumps is extruded tubing. As a result of its production, such tubing has variations in wall thickness as well as in overall inner and outer diameters. These variations can be enough to change a typical calibration of a roller pump rotor to be under occlusive or over occlusive. As a result, the pump rate may change from the desired rate. In addition, variations in occlusion may cause harm to the fluid being pumped (e.g., blood) or to the tubing itself, thereby causing risk of tubing spallation or even rupture.

Some prior art roller pumps do not allow adjustment of the distance between the rollers, and have the distance between the rollers set during manufacture. If, however, a roller pump does provide a mechanism for manually adjusting the distance between the roller and the inner circumferential surface of the pump stator (i.e., adjusting the length of the roller arms), often the adjustments are inefficient to perform in the surgical field because they have to be followed by a time intensive calibration process of the pump.

As an alternative to adjusting the distance between the rollers on a rotor, in some roller pumps, the rotor may be removed and replaced with a rotor applicable for a different size of tubing or amount of occlusion. The process of changing out such a rotor is time intensive and may also require calibration of the pump.

SUMMARY OF THE INVENTION

The present invention overcomes the shortcomings of the prior art with respect to roller pumps by providing a roller pump rotor that is adjustable in the surgical field in order to change the amount of occlusivity (i.e., pump rate) of the roller pump. In addition, the roller pump rotor of the present invention does not require time-consuming calibration, and is therefore more efficient to use. Another advantage of the present invention is that the roller pump rotor has an uncomplicated design, and few parts, as compared to the prior art adjustable rotors. A further advantage of the present invention is that the rotor includes spring biased components affecting roller arm length, and thus there is some automatic adjustment and flexibility to variations typically seen in extruded tubing. An additional advantage with the present invention is that the spring force provided by the spring biased components and the rotor, in general, is constant and does not change.

A first aspect of the present invention is a pump rotor for a roller pump. One embodiment of the rotor comprises: a first roller support comprising a first roller; a second roller support comprising a second roller; an element in the center connected to the first and second roller supports, wherein the first and second roller supports may move angularly with respect to the center element causing distance between the first and second rollers to be varied; first and second positioning elements that connect the first and second roller supports, respectively, to the center element; and first and second spring biased components surrounding first and second positioning elements, respectively, to allow the first and second roller supports to move to allow for automatic adjustment of the rotor. The rotor may further comprise: an adjustment element; and a lever housed in the center element, wherein the lever is operatively connected to the adjustment element and the first and second positioning elements, and manual adjustment of the adjustment element causes movement of the lever, which in turn causes movement of the first and second positioning elements and in turn the first and second roller supports. The rotor may have a constant spring force. The first and second spring biased components may comprise springs. The rotor may further comprise at least one tubing guide extending from at least one of the first roller support and the second roller support. The first and second positioning elements may limit the movement of the first and second roller supports away from each other. The first and second spring biased components may allow movement of the first and second roller supports towards each other.

A second aspect of the present invention is a roller pump for pumping fluids through a tubing, the roller pump comprising: a pump stator comprising a chamber having a surface; and a pump rotor for compressing the tubing against the surface of the pump stator, the rotor comprising: a first roller support comprising a first roller; a second roller support comprising a second roller; an element in the center connected to the first and second roller supports, wherein the first and second roller supports may move angularly with respect to the center element causing distance between the first and second rollers to be varied; first and second positioning elements that connect the first and second roller supports, respectively, to the center element; and first and second spring biased components surrounding first and second positioning elements, respectively, to allow the first and second roller supports to move to allow for automatic adjustment of the rotor. The rotor of the roller pump may further comprise: an adjustment element; and a lever housed in the center element, wherein the lever is operatively connected to the adjustment element and the first and second positioning elements, and adjustment of the adjustment element causes movement of the lever, which in turn causes movement of the first and second positioning elements and in turn the first and second roller supports. The rotor of the roller pump may have a constant spring force. The first and second spring biased components may comprise springs. The rotor of the roller pump may further comprise at least one tubing guide extending from at least one of the first roller support and the second roller support. The first and second positioning elements may limit the movement of the first and second roller supports away from each other. The first and second spring biased components may allow movement of the first and second roller supports towards each other.

DETAILED DESCRIPTION OF THE INVENTION

The present invention is a pump rotor for a roller pump that is used to pump fluid though a tubing. Preferably, the pump rotor may be used in roller pumps that are used during cardiovascular surgery to facilitate circulation of blood between a patient and a heart-lung machine. Other exemplary uses include the transfer of blood between a patient and a kidney dialyzer, and intravenous (IV) feeding of IV solutions. Other uses for the invention are, however, contemplated although not particularly listed herein.

The present invention is a roller pump rotor that is adjustable in the surgical field in order to change the amount of occlusivity (i.e., pump rate) of the roller pump. The present invention does not require time-consuming calibration, and is therefore efficient to use. The roller pump rotor has an uncomplicated design, and few parts. The rotor includes spring biased components affecting roller arm length, and providing some automatic adjustment and flexibility in order to accommodate variations typically seen in extruded tubing used with the rotor. The spring force provided by the spring biased components and the rotor, in general, is constant and does not change.

With reference to the accompanying figures, wherein like components are labeled with like numerals throughout the several figures, a pump rotor assembly for a roller pump is disclosed, taught and suggested.

Figure 5:
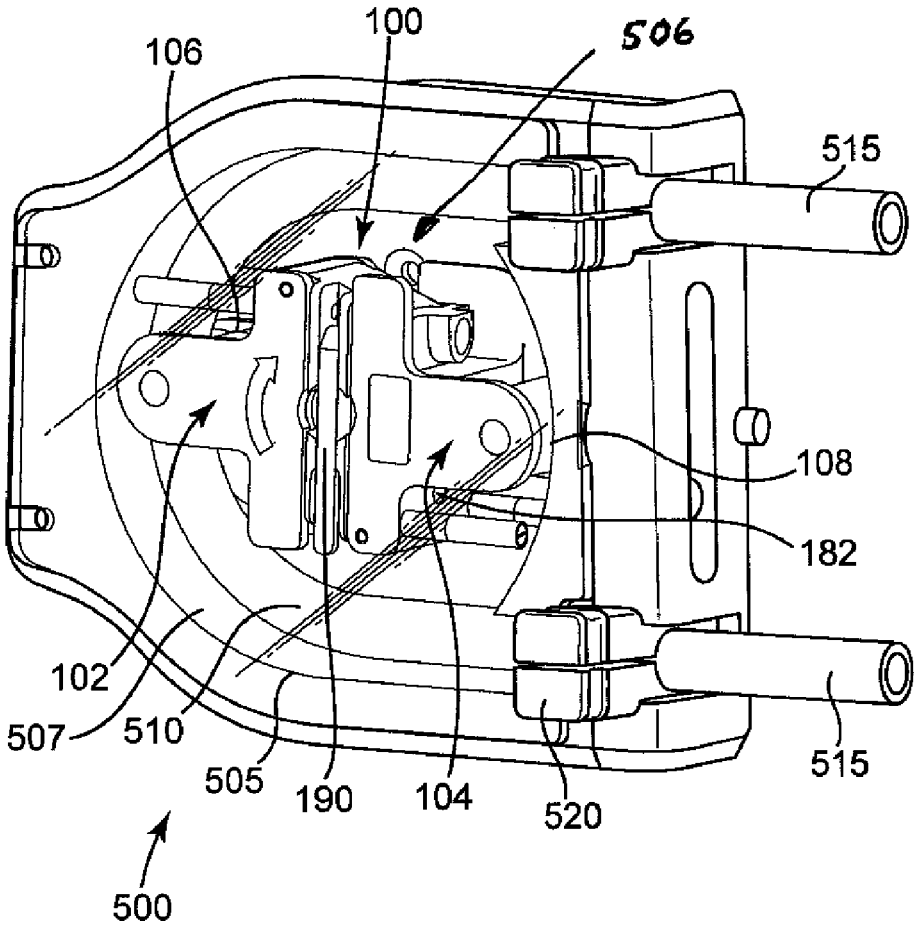
FIG. 5 is a perspective view of an exemplary roller pump head including an embodiment of a roller pump rotor in accordance with the present invention.

FIGS. 1-4 show different views of an embodiment of a pump rotor 100, in accordance with the present invention. Before the individual components of the pump rotor 100 are discussed, generally, the function and use of the pump rotor of the present invention in an exemplary pump head will be discussed. FIG. 5 shows an exemplary pump head 500 including one embodiment of the adjustable pump rotor 100 of the present invention and a pump stator 505.

In FIG. 5, pump head 500 comprises pump rotor 100 and pump stator 505, and is shown with tubing 515 loaded and a cover 510. Pump stator 505 generally comprises a chamber or housing 506 having an inner circumferential surface 507 against which tubing 515 is compressed or occluded by pump rotor 100. Pump rotor 100, is rotatable and arranged in pump stator 505 in such a manner that pump rotor 100 engages tubing 515 positioned in pump stator 505 with one or more rollers (preferably with two rollers, as shown in FIG. 5 as 106, 108). Upon rotation of pump rotor 100, rollers 106 and 108 compress tubing 515 as they are rolled along tubing 515 pressed against surface 507. A fluid medium contained within tubing 515 is thereby transported in a direction of pump rotor 100 rotation. In order to avoid tubing 515 from wandering within pump stator 505 while under the influence of rollers 106 and 108, the ends of tubing 515 entering and exiting the pump stator 505 are preferably fastened in place, or fixedly positioned, relative to the pump stator 505. Exemplary means for fastening the tubing includes tubing holding devices 520, as seen in FIG. 5, which are the subject of co-pending U.S. patent application having Ser. No. 11/526,150 and filed Sep. 22, 2006, which is incorporated herein by reference in its entirety.

Pump rotor 100, preferably, is both manually adjustable in the surgical field to vary the distance between rollers 106, 108 on the rotor 100 causing a change in the amount of occlusion of tubing in a roller pump, and automatically adjustable during operation using spring biased components or other such compressible elements (described below) that allow the distance between rollers 106, 108 to be varied for slight variations in tubing diameters or wall thickness. The components of pump rotor 100 are described in detail below.

FIGS. 1-4 show pump rotor 100 preferably comprising a first roller support 102 and a second roller support 104 that are a connected to a cam block 138, or center element, which houses additional components that will be discussed in more detail below. The first and second roller supports 102, 104 are moveable angularly with respect to cam block 138 in order to adjust or vary the distance between rollers 106, 108 on first and second roller supports 102, 104, which changes the occlusivity of the pump rotor 100.

First roller support 102 preferably includes roller 106 rotatably connected by a pin or bearing 110 to two endplates 114, 116 that are rigidly connected by a support plate 122. Roller 106 may freely rotate around pin 110. Endplates 114, 116 are preferably shaped to support pin 110 without obstructing roller 106. The shape preferably also allows pump rotor 100 to rotate in pump stator 505.

Support plate 122 is generally perpendicular to endplates 114, 116, and is preferably attached to endplates 114, 116 such that a portion of both endplates 114, 116 extends beyond the site of attachment to the support plate 122 opposite the portions of both endplates 114, 116 retaining roller 106. Support plate 122 includes apertures 172, 173 (FIG. 2), which will be described in more detail below.

Tubing guides 126 (in FIGS. 1, 2), 128 (in FIG. 3) preferably extend from endplates 114, 116, respectively, of first roller support 102. Tubing guides 126, 128 are located such that the tubing guides 126, 128 precede roller 106 on first roller support 102 in the direction of rotation (clockwise for FIGS. 1-5) of the rotor 100. Tubing guides 126, 128 serve to guide a segment of tubing 515 to roller 106 during operation of pump head 500 (as can be seen in FIG. 5).

Tubing guides 126, 128 are preferably cylindrical in shape and are preferably made of a lubricious material, for example an acetyl material, Teflon™, or made of a metal and coated with a lubricious material. The purpose of such an exemplary shape and exemplary materials is to allow tubing to slide easily between tubing guides 126, 128. Tubing guides 126, 128 are preferably mounted over a stainless steel pin (not visible in FIGS.) and held in place with a stainless steel bolt (not visible in FIGS.). Other configurations of tubing guides 126, 128 are also contemplated by the present invention. Also, alternative materials for tubing guides 126, 128 are contemplated by the present invention.

Preferably, a pin 134 (FIG. 1) rotatably attaches first roller support 102 near one end of the first roller support 102 to block 138. In order to rotatably attach first roller support 102 and block 138, pin 134 extends through aperture 113 in endplate 114 (FIG. 2), through aperture 137 on block 138 and through aperture 115 (FIG. 2) in endplate 116, which are all co-aligned. The attachment of the first roller support 102 to block 138 is preferably located near a corner of block 138 and an end of first roller support 102 such that the first roller support may rotate or move angularly with respect to block 138 in order to move roller 106 towards or away from block 138. The purpose of moving the roller 106 towards or away from block 138 is to change the occlusivity of the rotor 100. In other words, it allows for variance in the distance between roller 106 and roller 108 on second roller support 104, which is attached preferably at an opposite corner of block 138 as first roller support 102.

Preferably, second roller support 104 is similar to first roller support 102. First and second roller supports 102, 104, as shown, are also complementary with block 138. Second roller support 104 preferably includes roller 108 rotatably connected by a pin or bearing 112 to two endplates 118, 120 that are rigidly connected by a support plate 124. Roller 108 may also freely rotate around pin 112. Endplates 118, 120 are also preferably shaped to support pin 112 without obstructing the roller 108, and to allow pump rotor 100 to rotate in pump stator 505.

Support plate 124 is generally perpendicular to endplates 118, 120 and is preferably attached to endplates 118, 120 such that a portion of both endplates 118, 120 extends beyond the site of attachment to support plate 124 opposite the portions of both endplates 118, 120 retaining roller 108. Support plate 124 includes apertures 182, 183 (FIG. 3), which will be described in more detail below.

Tubing guides 130, 132 also similarly extend from second roller support 104, and precede roller 108 on second roller support 104 in the direction of rotation (clockwise for FIGS. 1-5), in order to guide tubing to roller 108 (as seen in FIG. 5). Tubing guides 130, 132 are also similarly made and configured as described above with regard to tubing guides 126, 128 on first roller support 102.

A second pin 136 also preferably rotatably attaches second roller support 104 near one end of second roller support 104 to block 138. Preferably, the first and second roller supports 102, 104 are attached at opposite corners of block 138. In order to rotatably attach second roller support 104 and block 138, pin 136 extends through aperture 117 in endplate 118 (FIG. 2), through aperture 139 on block 138 and through aperture 119 (FIG. 2) in endplate 120, which are all co-aligned. The attachment of second roller support 104 to block 138 is preferably located near the corner of block 138 opposite where first roller support 102 is attached. The attachment is configured such that second roller support 104 may rotate or move angularly with respect to block 138 in order to move roller 108 towards or away from block 138. The purpose of moving roller 108 towards or away from block 138 is to change the occlusivity of the rotor 100. In other words, it allows for variance in the distance between roller 108 and roller 106 on first roller support 102.

Figure 1:
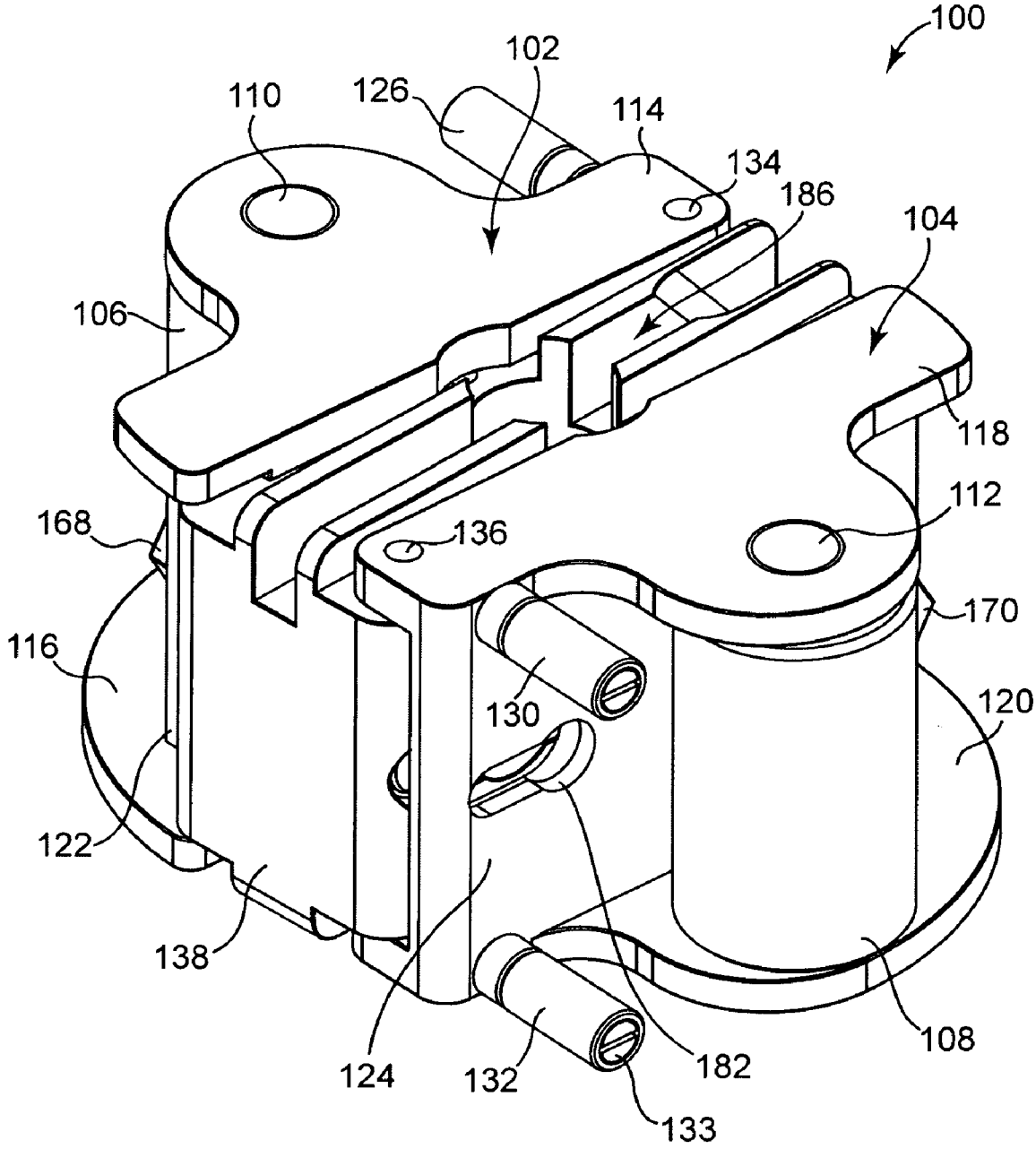
FIG. 1 is a perspective view of an embodiment of a roller pump rotor in accordance with the present invention.
Figure 2:
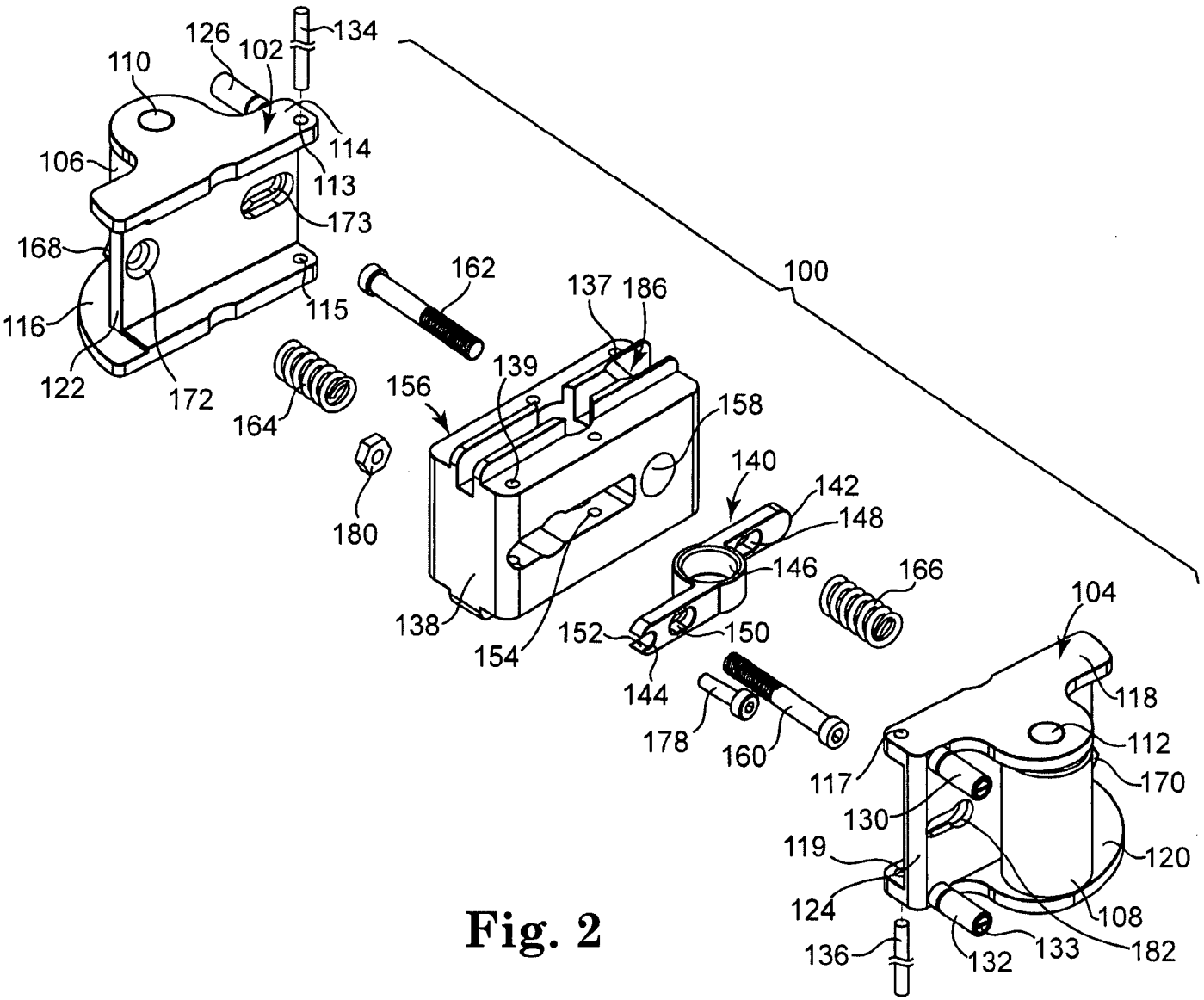
FIG. 2 is an exploded view of the roller pump rotor of FIG. 1.
Figure 3:
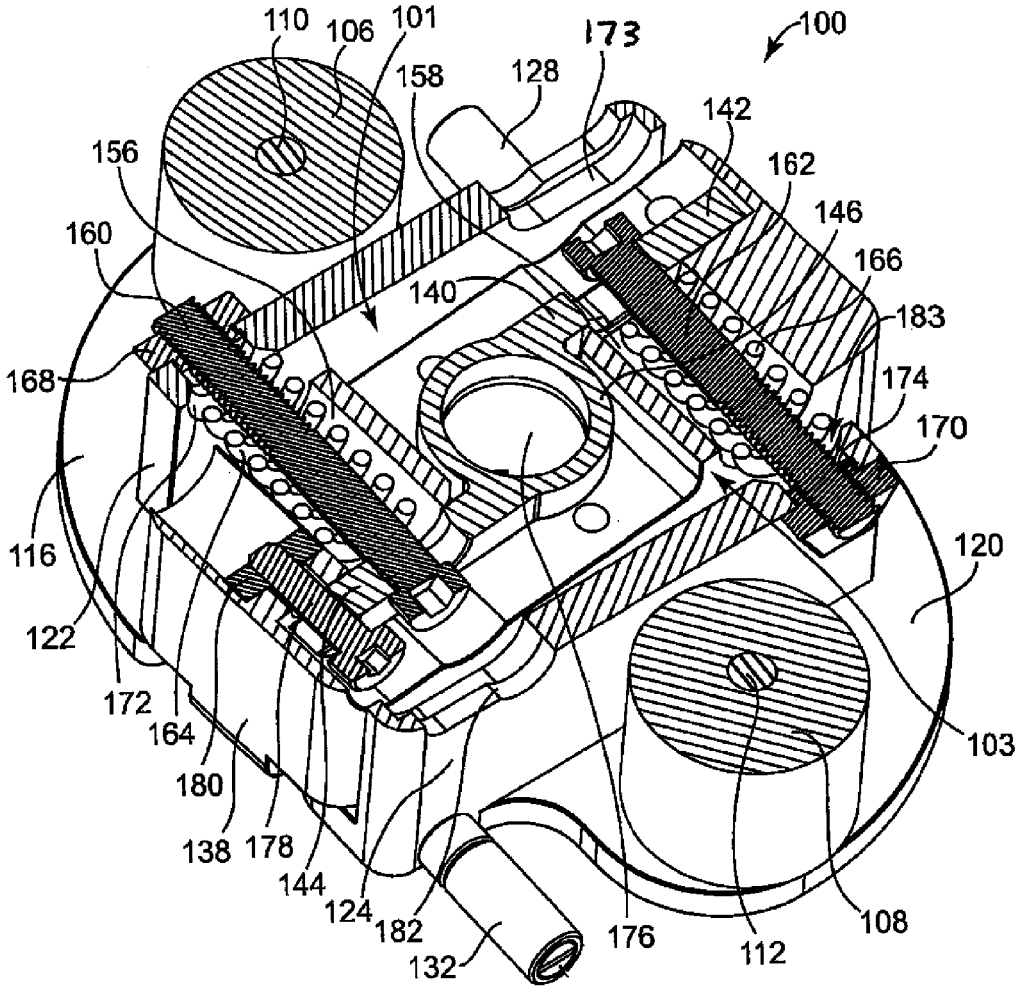
FIG. 3 is a cross-sectional view of the roller pump rotor of FIG. 1.
Figure 4:
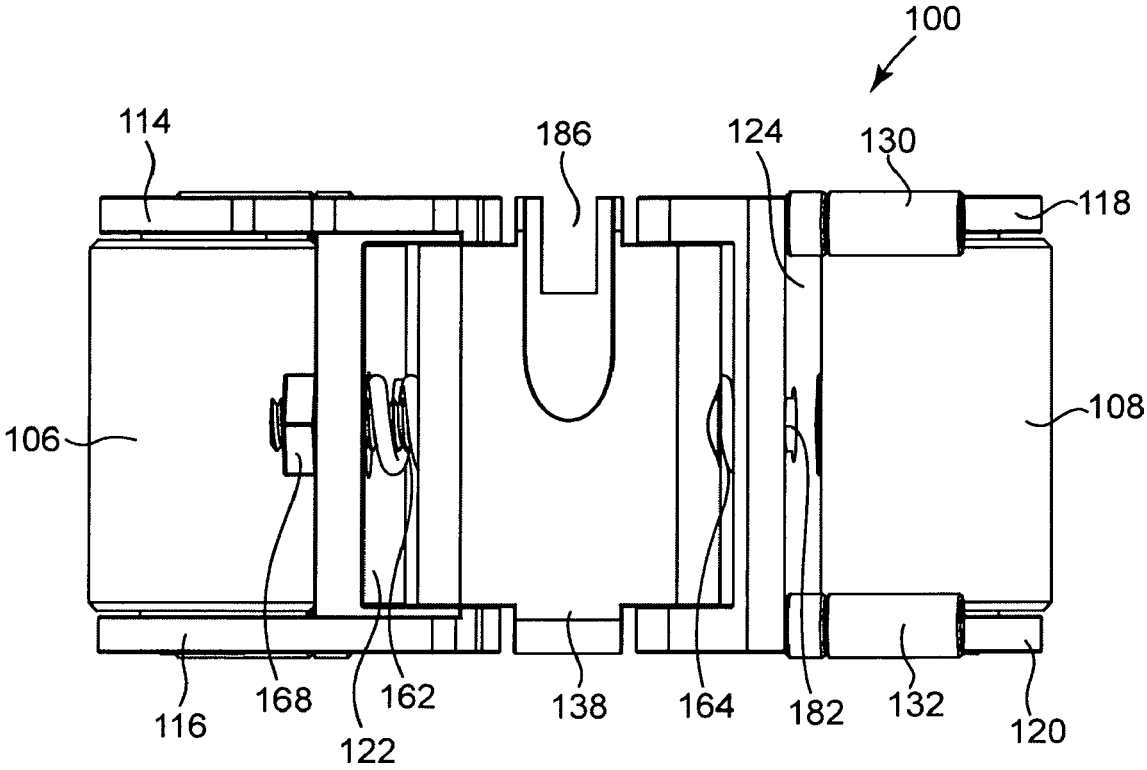
FIG. 4 is a side view of the roller pump rotor of FIG. 1.

FIGS. 2 and 3 show exemplary components of pump rotor 100 that are housed in or attached to block 138, which will be discussed in detail below. These components adjustably attach the first and second roller supports 102, 104 to block 138 allowing the first and second roller supports 102, 104 to rotate angularly at pins 134, 136, respectively, in block 138 in order to vary the distance between rollers 106, 108. Varying the distance between rollers 106, 108 allows for adjustment of the rotor 100 in order to provide for different occlusivities by a roller pump in which the rotor 100 is a component.

A first positioning element 160 and a second positioning element 162 preferably are rigidly attached to first and second roller supports 102, 104, respectively, at opposite ends of the supports 102, 104 from pins 134, 136 that rotatably attach the roller supports 102, 104 to block 138. Preferably, the positioning elements 160, 162 comprises bolts, but other such suitable positioning elements are also contemplated by the present invention. Positioning elements 160, 162 preferably serve to connect first and second roller supports 102, 104 to block 138 and when set provide the farthest distance that first and second roller supports 102, 104 may extend from each other.

As shown, first positioning element 160 preferably extends through first roller support 102 at aperture 172 and is attached using an attachment means, such as nut 168, for example. Similarly, second positioning element 162 extends through second roller support 104 at aperture 174 and is attached using nut 170. Preferably, nuts 168, 170 comprise a self-locking type nut with a nylon insert, but other suitable nuts or connection or attachment means may be used as well.

Preferably, first positioning element 160 extends from attachment to first roller support 102 through opening 156 in block 138 (which is a portion of lever slot 154) and through aperture 150 in lever 140. First positioning element 160 is not, however, permanently attached to lever 140, and aperture 150 in block 138 may slide along a portion of the length of first positioning element 160, which will be discussed in more detail below.

Similarly, second positioning element 162 extends from attachment to second roller support 104 through opening 158 in block 138 (which is portion of lever slot 154) and through aperture 148 in lever 140. Second positioning element 162 is also not permanently attached to lever 140, and aperture 148 in block 138 may slide along a portion of the length of second positioning element 162, which will also be discussed in more detail below.

The position of positioning elements 160, 162 are preferably set during manufacture, and such attachments are preferably not adjustable in the surgical field. Although the rotor 100 shown provides access to the positioning elements 160, 162 through apertures 182, 184 in first and second roller supports 102, 104, the rotor 100 could alternatively not include such access apertures.

Preferably, positioning elements 160, 162 are surrounded by a first spring biasing component 164 and a second spring biasing component 166, respectively. Spring biasing components 164, 166 preferably comprise springs or other means for compression, that loosely surround positioning elements 160, 162 in apertures 156, 158, respectively. Spring biasing component 164 is not attached but extends between and exerts forces on first roller support 102 and lever arm 144 to hold them apart. Spring biasing component 166, similarly, extends between and exerts forces on second roller support 104 and lever arm 142 to keep them apart.

Spring biasing components 164, 166 are provided to bias pump rotor 100 to an expanded state or configuration by exerting forces in order to push or hold first and second roller supports 102, 104 away from each other. Spring biasing components 164, 166 also allow first and second roller supports 102, 104 to move inward towards each other and reduce the distance between rollers 106, 108. Spring biasing components 164, 166 allow such automatic adjustment, or give, to preferably account for tubing variations during operation of pump head 500 (FIG. 5), for example.

The range of strengths of springs that may be used as spring biasing components 164, 166 preferably provide rotor 100 with a range of possible amounts of occlusion. An exemplary spring used in the present invention is a 50 kg spring. In general, it is preferred to use a spring exerting a force that is slightly above the force necessary to occlude the tubing that is used in the roller pump.

A component that is housed in block 138 is a lever 140, which has two lever arms 142, 144 and a center circular portion 146. The lever 140 includes two positioning element apertures 148, 150 and one adjustment element aperture 152 (FIG. 2), through which other components of the rotor assembly 100 are placed to control movement or placement of lever 140, as will be discussed below.

Lever 140 is preferably housed in block 138 in a lever slot 154. Lever 140 preferably floats loosely in lever slot 154, unless forces are exerted on the lever 140 by other components of the rotor 100, which will be described below. Lever slot 154 also preferably coordinates with two openings 156, 158 in block 138 to accommodate other components, as will be discussed below.

Circular aperture 176 in block 138 preferably surrounds and fits on a rotating shaft portion of a pump drive (not shown) in order to provide rotor 100 with rotational movement. When rotor 100 is assembled and lever 140 is in slot 154, the center circular portion 146 of lever 140 is preferably coaxially aligned with circular aperture 176 in block 138 (see FIG. 3). Center circular portion 146 of lever, however, is preferably loosely surrounding the pump drive shaft (not shown), and is not attached to the pump drive shaft.

When first and second roller supports 102, 104 are rotatably attached to block 138, such as in FIGS. 1, 3, 4 and 5, there is preferably a first space 101 between first roller support and block 138 and a second space 103 between second roller support 104 and block 138. The purpose of the spaces 101, 103 is to allow the first and second roller supports 102, 104, (i.e., rollers 106, 108) to move inward towards each other during operation of the pump 500 for tubing variations, for example. The spaces 101, 103, allow the first and second roller supports 102, 104 to move inward and the spring biased components 164, 166 to be compressed. Portions of block 138 fit inside spaces 101, 102 in first and second roller supports 102, 104 near support plates 122, 124 and opposite rollers 106, 108.

Thus, if automatic adjustment of the rotor 100 is necessary during operation of the pump 500 for tubing diameter inconsistencies, etc., then one or more of the rollers 106, 108 moves inward due to such an inconsistency in the tubing, for example. As a result of roller 106 or 108 being pushed inward, the first 102 or second roller support 104 then moves inward to compensate. Spaces 101 and 103 allow the first and second roller supports 102, 104 to move inward toward the block 138. The inward movement of the first and/or second roller supports 102, 104 is allowed by the spring biased components 164, 166 surrounding the positioning elements 160, 162, which are attached to the first or second roller support 102, 104. Positioning element 160 or 162 is allowed to move inward and extend through the aperture 150 or 148 in lever 140, and the lever 140 is not moved during automatic adjustment.

In the present invention, manual adjustment for tubing size changes, for example, is also possible. Such adjustability may be desired in the surgical field to change occlusion amount or tubing size. In order to provide manual adjustment of rotor 100 in the surgical field, an adjustment element 178 is preferably included in order to move lever 140 and adjust the rotor 100. The adjustment element 178 may comprise a bolt or any other suitable such adjustment means.

Adjustment element 178 preferably extends through an aperture 152 (FIG. 2) on arm 144 of lever 140 and is attached to or fixed in block 138 using a nut 180. Access to adjustment element 178 is preferably provided through aperture 182 in second roller support 104. Adjustment element 178 may be tightened or loosened (screwed in or out), which moves lever 140 and causes positioning elements 160, 162 to either push first and second roller supports 102, 104 away from each other or pull them towards one another. Preferably, the amount of movement of the adjustment element 178 is from about 0.00001 inch (0.000254 mm) to about 0.001 inch (0.0254 mm), but other amounts are contemplated. Self-locking nut 180 prevents any undesired movement of the adjustment element 178 while in use or transport.

Thus, if manual adjustment of the rotor 100 is desired in the surgical field, the adjustment element 178 may be utilized. For example, in order to accommodate larger tubing than previously used in pump 500, adjustment element 178 would be screwed outward, thereby causing the rollers 106, 108 to move closer together. For smaller or lighter tubing, the adjustment element 178 would be screwed inward, thereby causing the rollers 106, 108 to move farther away from each other.

Block 138 includes a slotted orifice 186 in which a manual rotation mechanism or hand crank may be preferably fit. Such a hand crank 190 (FIG. 5) is preferably used to manually rotate or reposition the pump rotor 100 of the present invention when tubing is being positioned or loaded within the pump 500, so that rollers 106, 108 properly engage the tubing. Although such a hand crank 190 is a preferred means for repositioning pump rotor 100, automated mechanisms may also be used to reposition the pump rotor 100 or stator 505 during the loading process.

Block 138 and first and second roller supports 102, 104, with the exception of the rollers 106, 108 and pins or bearings 110, 112, are preferably made of aluminum. Rollers 106, 108 and pins 110, 112 are preferably made of stainless steel. Other suitable materials for these and other components of pump rotor 100 are also contemplated by the present invention.

Tubing that may be compressed or occluded by the pump rotor of the present invention may be of various types and sizes. The tubing that is generally used is polyvinyl chloride (PVC) tubing. However, the present invention contemplates using tubing of any suitable material that is either known or that may be developed in the future. The preferred sizes of tubing that are used are ⅜ inch (0.375 inch, 9.525 mm), ¼ inch (0.25 inch, 6.35 mm) and ⅛ inch (0.125 inch, 3.175 mm) tubing. However, the present invention contemplates using other sizes of tubing as well.

A roller pump rotor of the present invention may be incorporated into any appropriate roller pump. An exemplary such roller pump head is shown in FIG. 5 incorporating the roller pump rotor of the present invention. The roller pump may comprise the rotor of the present invention, a pump stator and a drive unit used to rotate the rotor. Other components are, however, also contemplated by the present invention.

In order to adjust the pump rotor 100 of the present invention, tubing 515 is first loaded into the pump head 500 (FIG. 5). For example, with regard to pump head 500, in order to load tubing 515, the cover 510 is first opened. Tubing 515 is then manually placed in pump stator 505 and through tubing holding devices 520, and adjacent the inner circumferential wall 507. Next, manual rotation or use of a hand crank 190 attached to rotor 100 is then preferably used to manually rotate or position pump rotor 100 so that tubing 515 is correctly positioned within pump stator 505, thereby allowing rollers 106, 108 to properly engage tubing 515. Although hand crank 190 is the preferred method for repositioning pump stator 505, automated mechanisms may also be used to reposition pump stator 505 during the loading process.

Once tubing 515 is in place, then manual adjustment of rotor 100 may take place for a change in tubing size or desired amount of occlusion, for examples. The manual adjustment of adjustment element 178 (not visible in FIG. 5, but accessible through aperture 182) of the present invention moves lever 140 (not shown in FIG. 5, but in FIGS. 2, 3) and adjusts the distance between first and second roller supports 102, 104 of rotor 100. First and second roller supports 102, 104 are moved away or towards one another until rollers 106, 108 desirably compress tubing 515 against pump stator 505. This is done by screwing adjustment element 178 (FIGS. 2, 3) inward or outward.

As discussed above, automatic adjustment of the rotor 100 is possible because of first and second spring biased components 164, 166 allowing for automatic adjustment, or movement of the first and second roller supports towards one another.

Figure 6:
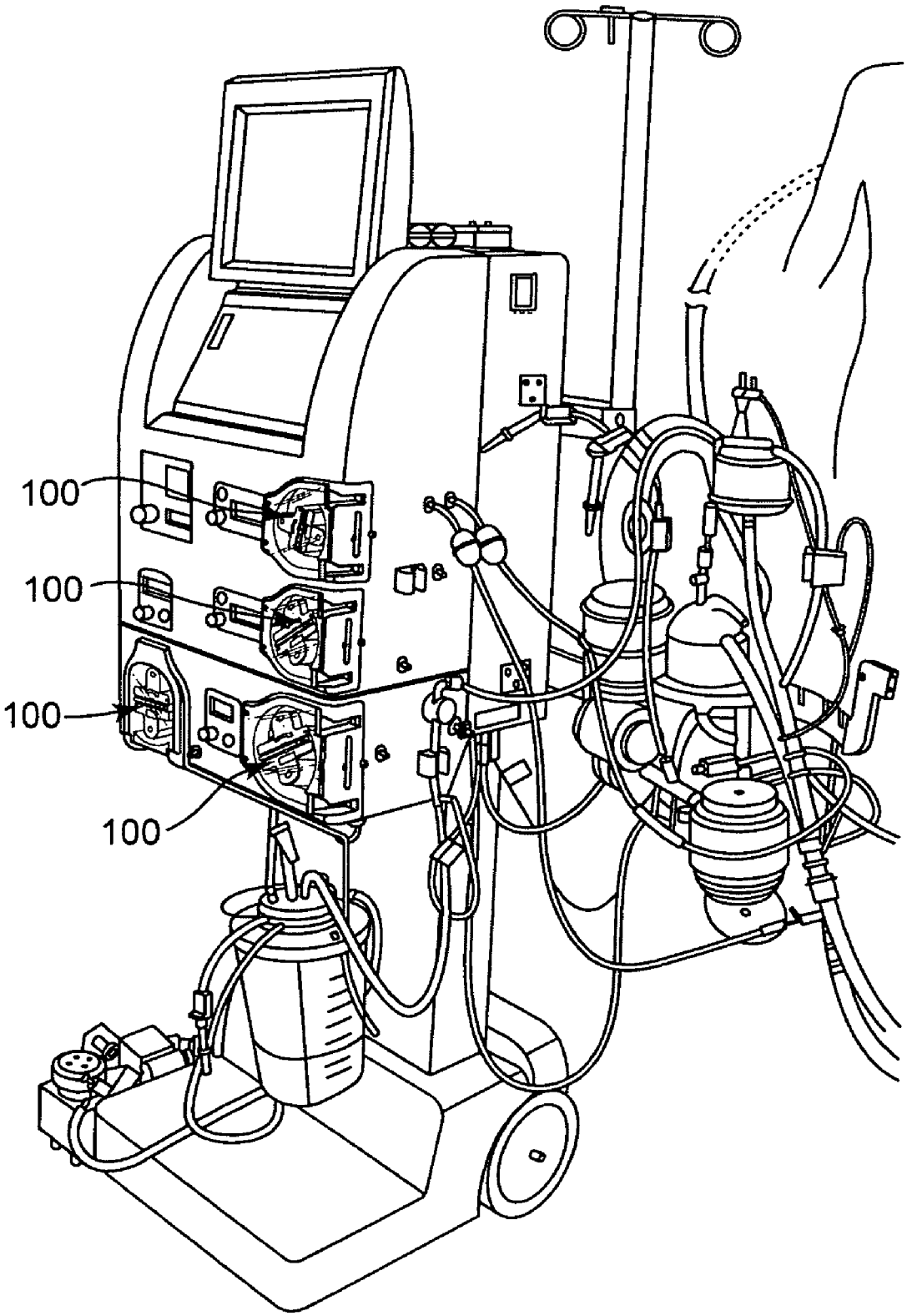
FIG. 6 is a perspective view of an advanced extracorporeal circulatory support system that incorporates exemplary embodiments of roller pump heads and roller pump rotors in accordance with the present invention.

A roller pump, including a pump rotor in accordance with the present invention, may be used or incorporated into any appropriate system or device in which blood or a similar fluid is desired to be driven or artificially circulated. One particular system in which the pump rotor of the present invention may be used is an advanced electromechanical extracorporeal circulatory support system used, for example, during cardiopulmonary bypass procedures. FIG. 6 shows such an exemplary system, including a plurality of pump rotors 100, in accordance with the present invention. A current exemplary CPB system, like that in FIG. 6, that may include the pump rotors 100 of the present invention, is commercially sold by Medtronic, Inc. (Minneapolis, Minn., U.S.A.) and is called the Performer-CPB System. Another example of a system in which pump rotor 100 can be included is disclosed in Italian Patent Application Nos. MO 2005A000244 (Borra et al., filed Sep. 23, 2005) and MO 2005A000243 (Borra et al., filed Sep. 23, 2005), which are incorporated by reference herein in their entirety.

While the present invention has been described with preferred embodiments, it is to be understood that variations and modifications may be resorted to as will be apparent to those skilled in the art. Such variations and modifications are to be considered within the purview of the scope of the present invention.

All patents, patent applications and publications mentioned herein are incorporated by reference in their entirety. The entire disclosure of each patent and publication cited herein is incorporated by reference, as if each such patent or publication were individually incorporated by reference herein.

The invention claimed is:

1. A pump rotor for a roller pump, the rotor comprising:

a first roller support comprising a first roller;

a second roller support comprising a second roller;

a center element located between the first and second roller supports and pivotally connected to the first and second roller supports, wherein the first and second roller supports are angularly movable with respect to the center element so that a distance between the first and second rollers can be varied;

first and second positioning elements that connect the first and second roller supports, respectively, to the center element at points spaced from the pivotal connections thereof so as to limit the extent of angular displacement of the first and second roller supports from the center element; and first and second spring biased components surrounding the first and second positioning elements, respectively, to bias the first and second roller supports away from the center element and to allow for inward movement and automatic adjustment of the rotor, wherein the first and second positioning elements are connected to the center element by way of a movable element that is adjustably supported to the center element and so that adjustment of the movable element changes the limit of angular displacement of both the first and second roller supports from the center element, and wherein the rotor further comprises an adjustment element for moving the movable element with respect to the center element; and a lever as the movable element that is housed in the center element, wherein the lever is operatively connected to the adjustment element and the first and second positioning elements, and manual adjustment of the adjustment element causes movement of the lever, which in turn causes movement of the first and second positioning elements and in turn the first and second roller supports.

2. The rotor of claim 1, wherein the rotor has a constant spring force.

3. The rotor of claim 1, wherein the first and second spring biased components comprise springs.

4. The rotor of claim 1, further comprising at least one tubing guide extending from at least one of the first roller support and the second roller support.

5. The rotor of claim 1, wherein the first and second positioning elements limit the movement of the first and second roller supports away from each other.

6. The rotor of claim 1, wherein the first and second spring biased components allow movement of the first and second roller supports towards each other.

7. A roller pump for pumping fluids through a tubing, the roller pump comprising:

a pump stator comprising a chamber having a surface; and a pump rotor for compressing the tubing against the surface of the pump stator, the rotor comprising:

a first roller support comprising a first roller;

a second roller support comprising a second roller;

a center element located between the first and second roller supports and pivotally connected to the first and second roller supports, wherein the first and second roller supports are angularly movable with respect to the center element so that a distance between the first and second rollers can be varied;

first and second positioning elements that connect the first and second roller supports, respectively, to the center element at points spaced from the pivotal connections thereof so as to limit the extent of angular displacement of the first and second roller supports from the center element; and first and second spring biased components surrounding the first and second positioning elements, respectively, to bias the first and second roller supports away from the center element and to allow for inward movement and automatic adjustment of the rotor, wherein the first and second positioning elements are connected to the center element by way of a movable element that is adjustably supported to the center element and so that adjustment of the movable element changes the limit of angular displacement of both the first and second roller supports from the center element, and wherein the rotor further comprises an adjustment element for moving the movable element with respect to the center element; and a lever as the movable element that is housed in the center element, wherein the lever is operatively connected to the adjustment element and the first and second positioning elements, and adjustment of the adjustment element causes movement of the lever, which in turn causes movement of the first and second positioning elements and in turn the first and second roller supports.

8. The roller pump of claim 7, wherein the rotor has a constant spring force.

9. The roller pump of claim 7, wherein the first and second spring biased components of the rotor comprise springs.

10. The roller pump of claim 7, wherein the rotor further comprises at least one tubing guide extending from at least one of the first roller support and the second roller support.

11. The roller pump of claim 7, wherein the first and second positioning elements of the rotor limit the movement of the first and second roller supports away from each other.

12. The roller pump of claim 7, wherein the first and second spring biased components of the rotor allow movement of the first and second roller supports towards each other.

* * * * *